US010422047B2

(12) United States Patent
Dyballa et al.

(10) Patent No.: US 10,422,047 B2
(45) Date of Patent: Sep. 24, 2019

(54) ELECTROCHEMICAL PROCESS FOR COUPLING OF PHENOL TO ANILINE

(71) Applicants: Katrin Marie Dyballa, Recklinghausen (DE); Robert Franke, Marl (DE); Dirk Fridag, Haltern am See (DE); Siegfried R. Waldvogel, Gau-Algesheim (DE); Bernd Elsler, Bonn (DE)

(72) Inventors: Katrin Marie Dyballa, Recklinghausen (DE); Robert Franke, Marl (DE); Dirk Fridag, Haltern am See (DE); Siegfried R. Waldvogel, Gau-Algesheim (DE); Bernd Elsler, Bonn (DE)

(73) Assignee: Evonik Degussa GmbH, Essen (DE)

( * ) Notice: Subject to any disclaimer, the term of this patent is extended or adjusted under 35 U.S.C. 154(b) by 239 days.

(21) Appl. No.: 14/773,102

(22) PCT Filed: Feb. 19, 2014

(86) PCT No.: PCT/EP2014/053231
§ 371 (c)(1),
(2) Date: Sep. 4, 2015

(87) PCT Pub. No.: WO2014/135371
PCT Pub. Date: Sep. 12, 2014

(65) Prior Publication Data

US 2016/0017504 A1 Jan. 21, 2016

(30) Foreign Application Priority Data

Mar. 7, 2013 (DE) ..... 10 2013 203 869
Feb. 7, 2014 (DE) ..... 10 2014 202 274

(51) Int. Cl.
*C25B 3/00* (2006.01)
*C25B 3/10* (2006.01)
*C25B 3/02* (2006.01)

(52) U.S. Cl.
CPC . *C25B 3/10* (2013.01); *C25B 3/02* (2013.01)

(58) Field of Classification Search
CPC ..... C25B 3/02; C25B 3/10
(Continued)

(56) References Cited

U.S. PATENT DOCUMENTS

2012/0080320 A1* 4/2012 Fischer ..... C25B 3/10 205/418

FOREIGN PATENT DOCUMENTS

CN 102459706 A 5/2012

OTHER PUBLICATIONS

Bao et al., "Electrochemical Synthesis of Phenol-Aniline Copolymerization Coating on 304 Stainless Steel Anodes and Coating Microstructure Analysis," Chin. J. Chem. Phys. (Feb. 27, 2011), vol. 24, No. 1, pp. 55-64. (Year: 2011).*

(Continued)

*Primary Examiner* — Edna Wong
(74) *Attorney, Agent, or Firm* — Oblon, McClelland, Maier & Neustadt, L.L.P.

(57) ABSTRACT

An electrochemical method for C—C coupling a phenol and an aniline in a reaction vessel containing a suitable solvent or solvent mixture and a conductive salt to produce biaryls having both hydroxyl and amino functions, wherein the difference in the oxidation potentials ΔE of the substrates ranges from 10 mV to 450 mV and the substrate with the highest oxidation potential is in excess, which method dispenses with multi-step syntheses using metallic reagents.

16 Claims, 9 Drawing Sheets

(58) Field of Classification Search
USPC ..... 205/414, 415, 416, 418, 419
See application file for complete search history.

(56) References Cited

OTHER PUBLICATIONS

Penketh, "The Oxidation Potentials of Phenolic and Amino Antioxidants," J. Appl. Chem. (Sep. 1957), vol. 7, pp. 512-521. (Year: 1957).*
Luo et al., "Accurate Oxidation Potentials of 40 Benzene and Biphenyl Derivatives with Heteroatom Substituents," J. Org. Chem. (2014), vol. 79, pp. 9297-9304. (Year: 2014).*
Mann et al., Electrochemical Reactions in Non-Aqueous Systems, Marcel Dekker, Inc (© 1970), p. 26. (Year: 1970).*
Rondinini et al., "Annali Di Chinnica," Ancrai (1977), vol. 67, Nos. 1-2, pp. 48 and 67. (Year: 1977).*
Bordwell et al., "The Relative Ease of Removing a Proton, a Hydrogen, or an Electron from Carboxamides versus Thiocarboxamides," J. Am. Chem. Soc. (1988), vol. 110, pp. 5903-5904. (Year: 1988).*
Brown et al., "Development and Characterization of Titanium Dioxide-Based Semiconductor Photoelectrochemical Dectector," Anal. Chem. (1992), vol. 64, pp. 427-434. (Year: 1992).*
Tadesse et al., "An Assessment of the Relative Contributions of Redox and Steric Issues to Laccase Specificity Towards Putative Substrates," Org. Biomol. Chem. (2008), vol. 6, pp. 868-878. (Year: 2008).*
U.S. Appl. No. 14/772,874, filed Sep. 4, 2015, Dyballa, et al.
U.S. Appl. No. 14/773,228, filed Sep. 4, 2015, Dyballa, et al.
U.S. Appl. No. 14/773,224, filed Sep. 4, 2015, Dyballa, et al.
Axel Kirste, et al., "Efficient Anodic and Direct Phenol-Arene C,C Cross-Coupling: The Benign Role of Water or Methanol," Journal of the American Chemical Society, vol. 134, No. 7, XP055114642, Feb. 22, 2012, pp. 3571-3576.
S. Domagala, et al., "Cross-Coupling Processes in Chemical and Electrochemical Oxidation of the Aniline Derivatives and 4-Aminophenol Mixtures," The 4$^{th}$ International Symposium Electrochemistry in Practice and Theory: Lodz, Lodz University Press, XP009177671, Jan. 1, 1997, 12 pages.
Axel Kirste, et al., "Anodic Phenol-Arene Cross-Coupling Reaction on Boron Doped Diamond Electrodes," Angewandte Chemie, International Edition, vol. 49, No. 5, XP002595230, pp. 971-975 (Jan. 25, 2010).
International Search Report dated May 8, 2014 in PCT/EP2014/053231 filed Feb. 19, 2014.
Singaporean Written Opinion dated Jun. 20, 2016 in Patent Application No. 11201507145Y.

* cited by examiner

$E_{ox}$ of 2,4-disubstituted anilines

$E_{ox}$ of 3,4-disubstituted anilines $E_{ox}$ of further aniline derivatives

**$E_{ox}$ of 4-substituted *N*-acetylanilines**

**$E_{ox}$ of 2,4-disubstituted *N*-acetylanilines**

**$E_{ox}$ of 3,4-disubstituted *N*-acetylanilines**

ELECTROCHEMICAL PROCESS FOR COUPLING OF PHENOL TO ANILINE

The present invention relates to an electrochemical process for coupling of phenol to aniline.

The terms "anilines" and "phenols" are used in this application as generic terms and thus encompass substituted aminoaryls and substituted hydroxyaryls.

The direct cross-coupling of unprotected phenol and aniline derivatives is known to date only by a conventional organic route and for very few examples. Here, principally superstoichiometric amounts of inorganic oxidizing agents such as Cu(II) (see: M. Smrcina, M. Lorenc, V. Hanus, P. Kocovsky, *Synlett,* 1991, 4, 231, M. Smrcina, S. Vyskocil, B. Maca, M. Polasek, T. A. Claxton, A. P. Abbott, P. Kocovsky, *J. Org. Chem.* 1994, 59, 2156, M. Smrcina, M. Lorenc, V. Hanus, P. Sedmera, P. Kocovsky, *J. Org. Chem.* 1992, 57, 191, M. Smrcina, J. Polakova, S. Vyskocil, P. Kocovsky, *J. Org. Chem.* 1993, 58, 4534) or Fe(III) (see: K. Ding, Q. Xu, Y. Wang, J. Liu, Z. Yu, B. Du, Y. Wu, H. Koshima, T. Matsuura, *Chem. Commun.* 1997, 7, 693, S. Vyskocil, M. Smrcina, M. Lorenc, P. Kocovsky, V. Hanus, M. Polasek, *Chem. Commun.* 1998, 5, 585) were utilized.

In rare cases, cross-coupling is possible by means of oxygen as an oxidizing agent when vanadium catalysts are used, as in S.-W. Hon, C.-H. Li, J.-H. Kuo, N. B. Barhate, Y.-H. Liu, Y. Wang, C.-T. Chen, *Org. Lett.* 2001, 3, 869.

Other synthesis routes involved either the protection of the amino group from the oxidative cross-coupling with transition metal catalysts or the subsequent introduction of these functional groups into the biaryl base skeleton (see R. A. Singer, S. L. Buchwald, *Tetrahedron Letters,* 1999, 40, 1095, K. Körber, W. Tang, X. Hu, X. Zhang, *Tetrahedron Letters,* 2002, 43, 7163, E. P. Studentsov, O. V. Piskunova, A. N. Skvortsov, N. K. Skvortsov, *Russ. J. Gen. Chem.* 2009, 79, 962, D. Sälinger, R. Brückner, *Synlett,* 2009, 1, 109)

A great disadvantage of the abovementioned methods for phenol-aniline cross-coupling is the frequent necessity for dry solvents and exclusion of air. In addition, large amounts of oxidizing agents, some of them toxic, are often used. During the reaction, toxic by-products often occur, which have to be separated from the desired product in a costly and inconvenient manner and disposed of at great cost. As a result of increasingly scarce raw materials (for example boron and bromine in the case of transition metal-catalysed cross-coupling) and the rising relevance of environmental protection, the cost of such transformations is rising. Particularly in the case of utilization of multistage sequences, an exchange between various solvents is necessary.

A problem which occurs in the electrochemical coupling of different molecules is that the co-reactants generally have different oxidation potentials $E_{Ox}$. The result of this is that the molecule having the lower oxidation potential has a higher drive to release an electron ($e^-$) to the anode and a $H^+$ ion to the solvent, for example, than the molecule having the higher oxidation potential. The oxidation potential $E_{Ox}$, can be calculated via the Nernst equation:

$$E_{Ox}=E^\circ+(0.059/n)*Ig([Ox]/[Red])$$

$E_{Ox}$: electrode potential for the oxidation reaction (=oxidation potential)

E°: standard electrode potential n: number of electrons transferred

[Ox]: concentration of the oxidized form

[Red]: concentration of the reduced form

If the literature methods cited above were to be applied to two different substrates, the result of this would be to form predominantly radicals of the molecule having a lower oxidation potential, and these would then react with one another. By far the predominant main product obtained would thus be a product which has formed from two identical substrates.

This problem does not occur in the coupling of identical molecules.

The problem addressed by the present invention was that of providing an electrochemical process in which anilines and phenols can be coupled to one another, and multistage syntheses using metallic reagents can be dispensed with.

The problem is solved by a process according to the invention.

Electrochemical process for coupling phenol to aniline, comprising the process steps of:

a') introducing a solvent or solvent mixture and a conductive salt into a reaction vessel, b') adding a phenol having an oxidation potential $E_{Ox}1$ to the reaction vessel, c') adding an aniline having an oxidation potential $E_{Ox}2$ to the reaction vessel, where:

$$E_{Ox}2>E_{Ox}1 \text{ and } E_{Ox}2-E_{Ox}1=\Delta E,$$

the aniline being added in excess relative to the phenol, and the solvent or solvent mixture being selected such that ΔE is within the range from 10 mV to 450 mV, d') introducing two electrodes into the reaction solution, e') applying a voltage to the electrodes, f') coupling the phenol and the aniline.

Process steps a) to c) can be effected here in any sequence.

Electrochemical process for coupling phenol to aniline, comprising the process steps of:

a") introducing a solvent or solvent mixture and a conductive salt into a reaction vessel, b") adding an aniline having an oxidation potential $E_{Ox}1$ to the reaction vessel, c") adding a phenol having an oxidation potential $E_{Ox}2$ to the reaction vessel, where:

$$E_{Ox}2>E_{Ox}1 \text{ and } E_{Ox}2-E_{Ox}1=\Delta E,$$

the phenol being added in excess relative to the aniline, and the solvent or solvent mixture being selected such that ΔE is within the range from 10 mV to 450 mV, d") introducing two electrodes into the reaction solution, e") applying a voltage to the electrodes, f") coupling the phenol and the aniline.

Process steps a) to c) can be effected here in any sequence.

By electrochemical treatment, phenols are coupled to anilines and the corresponding products are prepared, without needing to add organic oxidizing agents, to work with exclusion of moisture or to observe anaerobic reaction regimes. This direct method of C—C coupling opens up an inexpensive and environmentally friendly alternative to existing multistage synthesis routes conventional in organic synthesis.

Compounds of one of the general formulae (I) to (V) can be prepared by the process described:

(I)

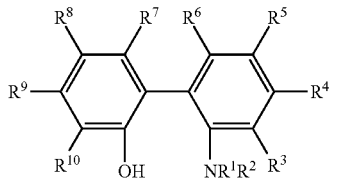

-continued (II)

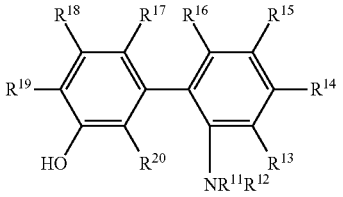

(III)

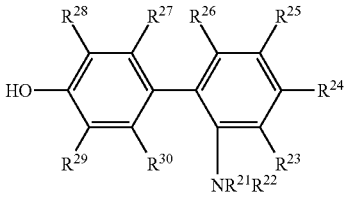

(IV)

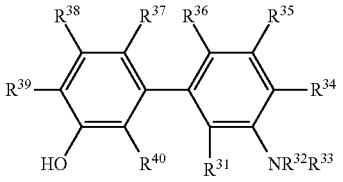

(V)

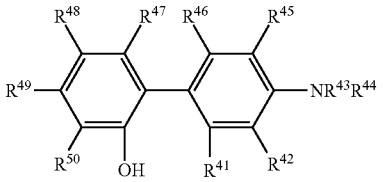

where the substituents $R^1$ to $R^{50}$ are each independently selected from the group of hydrogen, hydroxyl, $(C_1-C_{12})$-alkyl, $(C_1-C_{12})$-heteroalkyl, $(C_4-C_{14})$-aryl, $(C_4-C_{14})$-aryl-$(C_1-C_{12})$-alkyl, $(C_4-C_{14})$-aryl-O—$(C_1-C_{12})$-alkyl, $(C_3-C_{14})$-heteroaryl, $(C_3-C_{14})$-heteroaryl-$(C_1-C_{12})$-alkyl, $(C_3-C_{12})$-cycloalkyl, $(C_3-C_{12})$-cycloalkyl-$(C_1-C_{12})$-alkyl, $(C_3-C_{12})$-heterocycloalkyl, $(C_3-C_{12})$-heterocycloalkyl-$(C_1-C_{12})$-alkyl, O—$(C_1-C_{12})$-alkyl, O—$(C_1-C_{12})$-heteroalkyl, O—$(C_4-C_{14})$-aryl, O—$(C_4-C_{14})$-aryl-$(C_1-C_{14})$-alkyl, O—$(C_3-C_{14})$-heteroaryl, O—$(C_3-C_{14})$-heteroaryl-$(C_1-C_{14})$-alkyl, O—$(C_3-C_{12})$-cycloalkyl, O—$(C_3-C_{12})$-cycloalkyl-$(C_1-C_{12})$-alkyl, O—$(C_3-C_{12})$-heterocycloalkyl, O—$(C_3-C_{12})$-heterocycloalkyl-$(C_1-C_{12})$-alkyl, halogens, S—$(C_1-C_{12})$-alkyl, S—$(C_1-C_{12})$-heteroalkyl, S—$(C_4-C_{14})$-aryl, S—$(C_4-C_{14})$-aryl-$(C_1-C_{14})$-alkyl, S—$(C_3-C_{14})$-heteroaryl, S—$(C_3-C_{14})$-heteroaryl-$(C_1-C_{14})$-alkyl, S—$(C_3-C_{12})$-cycloalkyl, S—$(C_3-C_{12})$-cycloalkyl-$(C_1-C_{12})$-alkyl, S—$(C_3-C_{12})$-heterocycloalkyl, $(C_1-C_{12})$-acyl, $(C_4-C_{14})$-aroyl, $(C_4-C_{14})$-aroyl-$(C_1-C_{14})$-alkyl, $(C_3-C_{14})$-heteroaroyl, $(C_1-C_{14})$-dialkylphosphoryl, $(C_4-C_{14})$-diarylphosphoryl, $(C_3-C_{12})$-alkylsulphonyl, $(C_3-C_{12})$-cycloalkylsulphonyl, $(C_4-C_{12})$-arylsulphonyl, $(C_1-C_{12})$-alkyl-$(C_4-C_{12})$-arylsulphonyl, $(C_3-C_{12})$-heteroarylsulphonyl, (C═O)O—$(C_1-C_{12})$-alkyl, (C═O)O—$(C_1-C_{12})$-heteroalkyl, (C═O)O—$(C_4-C_{14})$-aryl, where the alkyl, heteroalkyl, cycloalkyl, heterocycloalkyl, aryl and heteroaryl groups mentioned are optionally mono- or polysubstituted.

Alkyl represents an unbranched or branched aliphatic radical.

Aryl for aromatic (hydrocarbyl) radicals, preferably having up to 14 carbon atoms, for example phenyl ($C_6H_5$—), naphthyl ($C_{10}H_7$—), anthryl ($C_{14}H_9$—), preferably phenyl.

Cycloalkyl for saturated cyclic hydrocarbons containing exclusively carbon atoms in the ring.

Heteroalkyl for an unbranched or branched aliphatic radical which may contain one to four, preferably one or two, heteroatom(s) selected from the group consisting of N, O, S and substituted N.

Heteroaryl for an aryl radical in which one to four, preferably one or two, carbon atom(s) may be replaced by heteroatoms selected from the group consisting of N, O, S and substituted N, where the heteroaryl radical may also be part of a larger fused ring structure.

Heterocycloalkyl for saturated cyclic hydrocarbons which may contain one to four, preferably one or two, heteroatom(s) selected from the group consisting of N, O, S and substituted N.

A heteroaryl radical which may be part of a fused ring structure is preferably understood to mean systems in which fused five- or six-membered rings are formed, for example benzofuran, isobenzofuran, indole, isoindole, benzothiophene, benzo(c)thiophene, benzimidazole, purine, indazole, benzoxazole, quinoline, isoquinoline, quinoxaline, quinazoline, cinnoline, acridine.

The substituted N mentioned may be monosubstituted, and the alkyl, heteroalkyl, cycloalkyl, heterocycloalkyl, aryl and heteroaryl groups may be mono- or polysubstituted, more preferably mono-, di- or trisubstituted, by radicals selected from the group consisting of hydrogen, $(C_1-C_{14})$-alkyl, $(C_1-C_{14})$-heteroalkyl, $(C_4-C_{14})$-aryl, $(C_4-C_{14})$-aryl-$(C_1-C_{14})$-alkyl, $(C_3-C_{14})$-heteroaryl, $(C_3-C_{14})$-heteroaryl-$(C_1-C_{14})$-alkyl, $(C_3-C_{12})$-cycloalkyl, $(C_3-C_{12})$-cycloalkyl-$(C_1-C_{14})$-alkyl, $(C_3-C_{12})$-heterocycloalkyl, $(C_3-C_{12})$-heterocycloalkyl-$(C_1-C_{14})$-alkyl, $CF_3$, halogen (fluorine, chlorine, bromine, iodine), $(C_1-C_{10})$-haloalkyl, hydroxyl, $(C_1-C_{14})$-alkoxy, $(C_4-C_{14})$-aryloxy, $(C_4-C_{14})$-aryl, $(C_3-C_{14})$-heteroaryloxy, $N((C_1-C_{14})\text{-alkyl})_2$, $N((C_4-C_{14})\text{-aryl})_2$, $N((C_1-C_{14})\text{-alkyl})((C_4-C_{14})\text{-aryl})$, where alkyl, aryl, cycloalkyl, heteroalkyl, heteroaryl and heterocycloalkyl are each as defined above.

In one embodiment, $R^1$, $R^2$, $R^{11}$, $R^{12}$, $R^{21}$, $R^{22}$, $R^{32}$, $R^{33}$, $R^{43}$, $R^{44}$ are selected from —H and/or a protecting group for amino functions described in "Greene's Protective Groups in Organic Synthesis" by P. G. M. Wuts and T. W. Greene, 4th edition, Wiley Interscience, 2007, p. 696-926.

In one embodiment, $R^3$, $R^4$, $R^5$, $R^6$, $R^7$, $R^8$, $R^9$, $R^{10}$, $R^{13}$, $R^{14}$, $R^{15}$, $R^{16}$, $R^{17}$, $R^{18}$, $R^{19}$, $R^{20}$, $R^{23}$, $R^{24}$, $R^{25}$, $R^{26}$, $R^{27}$, $R^{28}$, $R^{29}$, $R^{30}$, $R^{31}$, $R^{34}$, $R^{35}$, $R^{36}$, $R^{37}$, $R^{40}$, $R^{41}$, $R^{42}$, $R^{45}$, $R^{46}$, $R^{47}$, $R^{48}$, $R^{49}$, $R^{50}$ are selected from the group of hydrogen, hydroxyl, $(C_1-C_{12})$-alkyl, $(C_1-C_{12})$-heteroalkyl, $(C_4-C_{14})$-aryl, $(C_4-C_{14})$-aryl-$(C_1-C_{12})$-alkyl, O—$(C_1-C_{12})$-alkyl, O—$(C_1-C_{12})$-heteroalkyl, O—$(C_4-C_{14})$-aryl, O—$(C_4-C_{14})$-aryl-$(C_1-C_{14})$-alkyl, O—$(C_3-C_{14})$-heteroaryl, O—$(C_3-C_{14})$-heteroaryl-$(C_1-C_{14})$-alkyl, O—$(C_3-C_{12})$-cycloalkyl, O—$(C_3-C_{12})$-cycloalkyl-$(C_1-C_{12})$-alkyl, O—$(C_3-C_{12})$-heterocycloalkyl, O—$(C_3-C_{12})$-heterocycloalkyl-$(C_1-C_{12})$-alkyl, S—$(C_1-C_{12})$-alkyl, S—$(C_4-C_{14})$-aryl, halogens, where the alkyl, heteroalkyl, cycloalkyl, heterocycloalkyl, aryl and heteroaryl groups mentioned are optionally mono- or polysubstituted.

In one embodiment, $R^1$, $R^2$, $R^{11}$, $R^{12}$, $R^{21}$, $R^{22}$, $R^{32}$, $R^{33}$, $R^{43}$, $R^{44}$ are selected from: —H, $(C_1-C_{12})$-acyl.

In one embodiment, $R^3$, $R^4$, $R^5$, $R^6$, $R^7$, $R^8$, $R^9$, $R^{10}$, $R^{13}$, $R^{14}$, $R^{15}$, $R^{16}$, $R^{17}$, $R^{18}$, $R^{19}$, $R^{20}$, $R^{23}$, $R^{24}$, $R^{25}$, $R^{26}$, $R^{27}$, $R^{28}$, $R^{29}$, $R^{30}$, $R^{31}$, $R^{34}$, $R^{35}$, $R^{36}$, $R^{37}$, $R^{40}$, $R^{41}$, $R^{42}$, $R^{45}$, $R^{46}$, $R^{47}$, $R^{48}$, $R^{49}$, $R^{50}$ are selected from: hydrogen, hydroxyl, $(C_1-C_{12})$-alkyl, $(C_4-C_{14})$-aryl, O—$(C_1-C_{12})$-alkyl, O—$(C_1-C_{12})$-heteroalkyl, O—$(C_4-C_{14})$-aryl, O—$(C_3-C_{12})$-cycloalkyl, S—$(C_1-C_{12})$-alkyl, S—$(C_4-C_{14})$-aryl, halogens, where the alkyl, heteroalkyl, cycloalkyl and aryl groups mentioned are optionally mono- or polysubstituted.

The process can be conducted at different carbon electrodes (glassy carbon, boron-doped diamond, graphite, carbon fibres, nanotubes, inter alia), metal oxide electrodes and metal electrodes. Current densities in the range of 1-50 $mA/cm^2$ are applied.

The workup and recovery of the biaryls is very simple and is effected by common standard separation methods after the reaction has ended. First of all, the electrolyte solution is distilled once and the individual compounds are obtained separately in the form of different fractions. A further purification can be effected, for example, by crystallization, distillation, sublimation or chromatography.

The electrolysis is conducted in the customary electrolysis cells known to those skilled in the art. Suitable electrolysis cells are known to those skilled in the art.

One aspect of the invention is that the yield of the reaction can be controlled via the difference in the oxidation potentials (ΔE) of the two substrates.

The process according to the invention solves the problem mentioned at the outset. For an efficient reaction regime, two reaction conditions are necessary:

- the substrate having the higher oxidation potential has to be added in excess, and
- the difference in the two oxidation potentials (ΔE) has to be within a particular range.

For the process according to the invention, the knowledge of the absolute oxidation potentials of the phenols and anilines is not absolutely necessary. It is sufficient when the difference between the two oxidation potentials is known.

A further aspect of the invention is that the difference in the two oxidation potentials (ΔE) can be influenced via the solvents or solvent mixtures used.

For instance, the difference in the two oxidation potentials (ΔE) can be shifted into the desired range by suitable selection of the solvent/solvent mixture.

Proceeding from 1,1,1,3,3,3-hexafluoroisopropanol (HFIP) as the base solvent, an excessively small ΔE can be increased, for example, by addition of alcohol. An excessively large ΔE, in contrast, can be lowered by addition of water.

The reaction sequence which proceeds is shown in the following scheme:

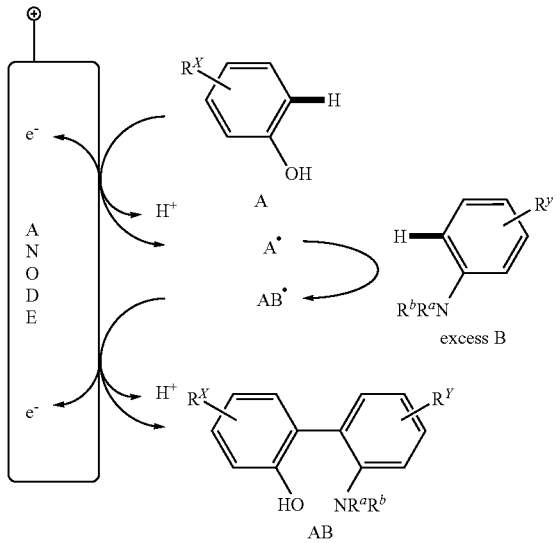

In the solvents mentioned, the selective oxidation of a phenol component A is enabled, this being able to be attacked nucleophilically by component B as a result of the high reactivity of the radical species formed. The first oxidation potentials of the two substrates appear to be crucial here for the success of the reaction. The controlled addition of protic additives such as MeOH or water to the electrolyte can enable a shift in precisely these oxidation potentials. Thus, it is possible to control yield and selectivity of this reaction.

With the aid of the process according to the invention, it has been possible for the first time to electrochemically prepare biaryls having hydroxyl and amino functions, and to dispense with multistage syntheses using metallic reagents.

If the aniline has the higher oxidation potential, in one variant of the process, the aniline is used in at least twice the amount relative to the phenol.

If the aniline has the higher oxidation potential, in one variant of the process, the ratio of phenol to aniline is in the range from 1:2 to 1:4.

If the phenol has the higher oxidation potential, in one variant of the process, the phenol is used in at least twice the amount relative to the aniline.

If the phenol has the higher oxidation potential, in one variant of the process, the ratio of aniline to phenol is in the range from 1:2 to 1:4.

In one variant of the process, the conductive salt is selected from the group of alkali metal, alkaline earth metal, tetra($C_1$-$C_6$-alkyl)ammonium, 1,3-di($C_1$-$C_6$-alkyl)imidazolium or tetra($C_1$-$C_6$-alkyl)phosphonium salts.

In one variant of the process, the counterions of the conductive salts are selected from the group of sulphate, hydrogensulphate, alkylsuiphates, arylsulphates, alkylsulphonates, arylsulphonates, halides, phosphates, carbonates, alkylphosphates, alkylcarbonates, nitrate, tetrafluoroborate, hexafluorophosphate, hexafluorosilicate, fluoride and perchlorate.

In one variant of the process, the conductive salt is selected from tetra($C_1$-$C_6$-alkyl)ammonium salts, and the counterion is selected from sulphate, alkylsulphate, arylsulphate.

In one variant of the process, the reaction solution is free of fluorinated compounds.

In one variant of the process, the reaction solution is free of transition metals.

In one variant of the process, the reaction solution is free of organic oxidizing agents.

In one variant of the process, the phenol and the aniline are selected from: Ia, Ib, IIa, IIb, IIIa, IIIb, IVa, IVb, Va, Vb:

(Ia)

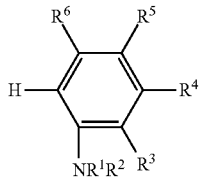

(Ib)

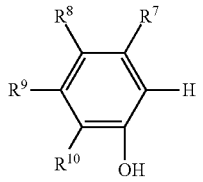

-continued (IIa)

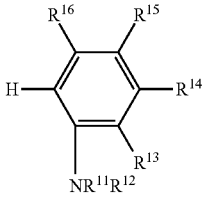

(IIb)

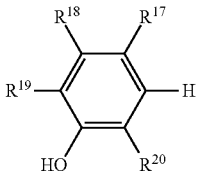

(IIIa)

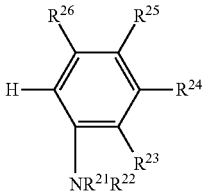

(IIIb)

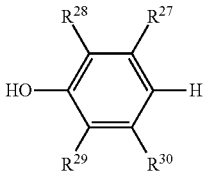

(IVa)

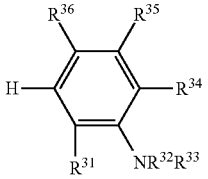

(IVb)

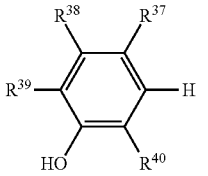

(Va)

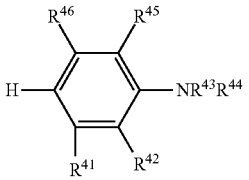

(Vb)

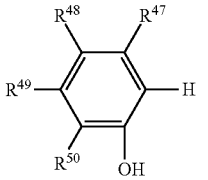

where the substituents $R^1$ to $R^{50}$ are each independently selected from the group of hydrogen, hydroxyl, $(C_1-C_{12})$-alkyl, $(C_1-C_{12})$-heteroalkyl, $(C_4-C_{14})$-aryl, $(C_4-C_{14})$-aryl-$(C_1-C_{12})$-alkyl, $(C_4-C_{14})$-aryl-O—$(C_1-C_{12})$-alkyl, $(C_3-C_{14})$-heteroaryl, $(C_3-C_{14})$-heteroaryl-$(C_1-C_{12})$-alkyl, $(C_3-C_{12})$-cycloalkyl, $(C_3-C_{12})$-cycloalkyl-$(C_1-C_{12})$-alkyl, $(C_3-C_{12})$-heterocycloalkyl, $(C_3-C_{12})$-heterocycloalkyl-$(C_1-C_{12})$-alkyl, O—$(C_1-C_{12})$-alkyl, O—$(C_1-C_{12})$-heteroalkyl, O—$(C_4-C_{14})$-aryl, O—$(C_4-C_{14})$-aryl-$(C_1-C_{14})$-alkyl, O—$(C_3-C_{14})$-heteroaryl, O—$(C_3-C_{14})$-heteroaryl-$(C_1-C_{14})$-alkyl, O—$(C_3-C_{12})$-cycloalkyl, O—$(C_3-C_{12})$-cycloalkyl-$(C_1-C_{12})$-alkyl, O—$(C_3-C_{12})$-heterocycloalkyl, O—$(C_3-C_{12})$-heterocycloalkyl-$(C_1-C_{12})$-alkyl, halogens, S—$(C_1-C_{12})$-alkyl, S—$(C_1-C_{12})$-heteroalkyl, S—$(C_4-C_{14})$-aryl, S—$(C_4-C_{14})$-aryl-$(C_1-C_{14})$-alkyl, S—$(C_3-C_{14})$-heteroaryl, S—$(C_3-C_{14})$-heteroaryl-$(C_1-C_{14})$-alkyl, S—$(C_3-C_{12})$-cycloalkyl, S—$(C_3-C_{12})$-cycloalkyl-$(C_1-C_{12})$-alkyl, S—$(C_3-C_{12})$-heterocycloalkyl, $(C_1-C_{12})$-acyl, $(C_4-C_{14})$-aroyl, $(C_4-C_{14})$-aroyl-$(C_1-C_{14})$-alkyl, $(C_3-C_{14})$-heteroaroyl, $(C_1-C_{14})$-dialkylphosphoryl, $(C_4-C_{14})$-diarylphosphoryl, $(C_3-C_{12})$-alkylsulphonyl, $(C_3-C_{12})$-cycloalkylsulphonyl, $(C_4-C_{12})$-arylsulphonyl, $(C_1-C_{12})$-alkyl-$(C_4-C_{12})$-arylsulphonyl, $(C_3-C_{12})$-heteroarylsulphonyl, (C═O)O—$(C_1-C_{12})$-alkyl, (C═O)O—$(C_1-C_{12})$-heteroalkyl, (C═O)O—$(C_4-C_{14})$-aryl, where the alkyl, heteroalkyl, cycloalkyl, heterocycloalkyl, aryl and heteroaryl groups mentioned are optionally mono- or polysubstituted.

Alkyl represents an unbranched or branched aliphatic radical.

Aryl for aromatic (hydrocarbyl) radicals, preferably having up to 14 carbon atoms, for example phenyl ($C_6H_5$—), naphthyl ($C_{10}H_7$—), anthryl ($C_{14}H_9$—), preferably phenyl.

Cycloalkyl for saturated cyclic hydrocarbons containing exclusively carbon atoms in the ring.

Heteroalkyl for an unbranched or branched aliphatic radical which may contain one to four, preferably one or two, heteroatom(s) selected from the group consisting of N, O, S and substituted N.

Heteroaryl for an aryl radical in which one to four, preferably one or two, carbon atom(s) may be replaced by heteroatoms selected from the group consisting of N, O, S and substituted N, where the heteroaryl radical may also be part of a larger fused ring structure.

Heterocycloalkyl for saturated cyclic hydrocarbons which may contain one to four, preferably one or two, heteroatom(s) selected from the group consisting of N, O, S and substituted N.

A heteroaryl radical which may be part of a fused ring structure is preferably understood to mean systems in which fused five- or six-membered rings are formed, for example benzofuran, isobenzofuran, indole, isoindole, benzothiophene, benzo(c)thiophene, benzimidazole, purine, indazole, benzoxazole, quinoline, isoquinoline, quinoxaline, quinazoline, cinnoline, acridine.

The substituted N mentioned may be monosubstituted, and the alkyl, heteroalkyl, cycloalkyl, heterocycloalkyl, aryl and heteroaryl groups may be mono- or polysubstituted, more preferably mono-, di- or trisubstituted, by radicals selected from the group consisting of hydrogen, $(C_1-C_{14})$-alkyl, $(C_1-C_{14})$-heteroalkyl, $(C_4-C_{14})$-aryl, $(C_4-C_{14})$-aryl-$(C_1-C_{14})$-alkyl, $(C_3-C_{14})$-heteroaryl, $(C_3-C_{14})$-heteroaryl-$(C_1-C_{14})$-alkyl, $(C_3-C_{12})$-cycloalkyl, $(C_3-C_{12})$-cycloalkyl-$(C_1-C_{14})$-alkyl, $(C_3-C_{12})$-heterocycloalkyl, $(C_3-C_{12})$-heterocycloalkyl-$(C_1-C_{14})$-alkyl, $CF_3$, halogen (fluorine, chlorine, bromine, iodine), $(C_1-C_{10})$-haloalkyl, hydroxyl, $(C_1-C_{14})$-alkoxy, $(C_4-C_{14})$-aryloxy, O—$(C_1-C_{14})$-alkyl-$(C_4-C_{14})$-aryl, $(C_3-C_{14})$-heteroaryloxy, $N((C_1-C_{14})\text{-alkyl})_2$, $N((C_4-C_{14})\text{-aryl})_2$, $N((C_1-C_{14})\text{-alkyl})((C_4-C_{14})\text{-aryl})$, where alkyl, aryl, cycloalkyl, heteroalkyl, heteroaryl and heterocycloalkyl are each as defined above.

In one embodiment, $R^1$, $R^2$, $R^{11}$, $R^{12}$, $R^{21}$, $R^{22}$, $R^{32}$, $R^{33}$, $R^{43}$, $R^{44}$ are selected from —H and/or a protecting group for amino functions described in "Greene's Protective Groups in Organic Synthesis" by P. G. M. Wuts and T. W. Greene, 4th edition, Wiley Interscience, 2007, p. 696-926.

In one embodiment, $R^3$, $R^4$, $R^5$, $R^6$, $R^7$, $R^8$, $R^9$, $R^{10}$, $R^{13}$, $R^{14}$, $R^{15}$, $R^{16}$, $R^{17}$, $R^{18}$, $R^{19}$, $R^{20}$, $R^{23}$, $R^{24}$, $R^{25}$, $R^{26}$, $R^{27}$, $R^{28}$, $R^{29}$, $R^{30}$, $R^{31}$, $R^{34}$, $R^{35}$, $R^{36}$, $R^{37}$, $R^{40}$, $R^{41}$, $R^{42}$, $R^{45}$, $R^{46}$, $R^{47}$, $R^{46}$, $R^{49}$, $R^{50}$ are selected from the group of hydrogen, hydroxyl, $(C_1\text{-}C_{12})$-alkyl, $(C_1\text{-}C_{12})$-heteroalkyl, $(C_4\text{-}C_{14})$-aryl, $(C_4\text{-}C_{14})$-aryl-$(C_1\text{-}C_{12})$-alkyl, O—$(C_1\text{-}C_{12})$-alkyl, O—$(C_1\text{-}C_{12})$-heteroalkyl, O—$(C_4\text{-}C_{14})$-aryl, O—$(C_4\text{-}C_{14})$-aryl-$(C_1\text{-}C_{14})$-alkyl, O—$(C_3\text{-}C_{14})$-heteroaryl, O—$(C_3\text{-}C_{14})$-heteroaryl-$(C_1\text{-}C_{14})$-alkyl, O—$(C_3\text{-}C_{12})$-cycloalkyl, O—$(C_3\text{-}C_{12})$-cycloalkyl-$(C_1\text{-}C_{12})$-alkyl, O—$(C_3\text{-}C_{12})$-heterocycloalkyl, O—$(C_3\text{-}C_{12})$-heterocycloalkyl-$(C_1\text{-}C_{12})$-alkyl, S—$(C_1\text{-}C_{12})$-alkyl, S—$(C_4\text{-}C_{14})$-aryl, halogens, where the alkyl, heteroalkyl, cycloalkyl, heterocycloalkyl, aryl and heteroaryl groups mentioned are optionally mono- or polysubstituted.

In one embodiment, $R^1$, $R^2$, $R^{11}$, $R^{12}$, $R^{21}$, $R^{22}$, $R^{32}$, $R^{33}$, $R^{43}$, $R^{44}$ are selected from: —H, $(C_1\text{-}C_{12})$-acyl.

In one embodiment, $R^3$, $R^4$, $R^5$, $R^6$, $R^7$, $R^8$, $R^9$, $R^{10}$, $R^{13}$, $R^{14}$, $R^{15}$, $R^{16}$, $R^{17}$, $R^{18}$, $R^{19}$, $R^{20}$, $R^{23}$, $R^{24}$, $R^{25}$, $R^{26}$, $R^{27}$, $R^{28}$, $R^{29}$, $R^{30}$, $R^{31}$, $R^{34}$, $R^{35}$, $R^{36}$, $R^{37}$, $R^{40}$, $R^{41}$, $R^{42}$, $R^{45}$, $R^{46}$, $R^{47}$, $R^{48}$, $R^{49}$, $R^{50}$ are selected from the group of hydrogen, hydroxyl, $(C_1\text{-}C_{12})$-alkyl, $(C_4\text{-}C_{14})$-aryl, O—$(C_1\text{-}C_{12})$-alkyl, O—$(C_1\text{-}C_{12})$-heteroalkyl, O—$(C_4\text{-}C_{14})$-aryl, O—$(C_3\text{-}C_{12})$-cycloalkyl, S—$(C_1\text{-}C_{12})$-alkyl, S—$(C_4\text{-}C_{14})$-aryl, halogens, where the alkyl, heteroalkyl, cycloalkyl and aryl groups mentioned are optionally mono- or polysubstituted.

In this context, the following combinations are possible:

| | | | | | |
|---|---|---|---|---|---|
| aniline | Ia | IIa | IIIa | IVa | Va |
| phenol | Ib | IIb | IIIb | IVb | Vb |

The invention is illustrated in detail hereinafter by working examples and figures.

TABLE 1

| Component 1 | Component 2 | Product | Yield (isolated)[a] | Selectivity (AB:BB)[b] |
|---|---|---|---|---|
| 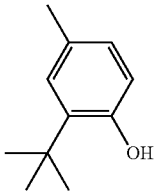 | 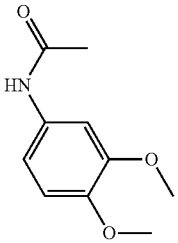 | 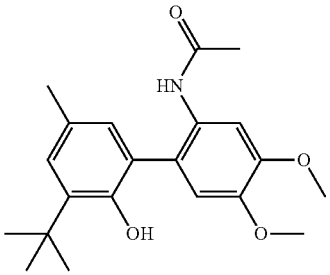 | 33% | >100:1 |
| 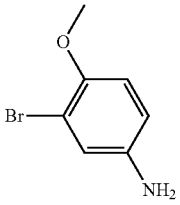 | 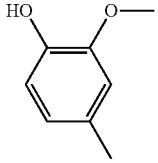 | 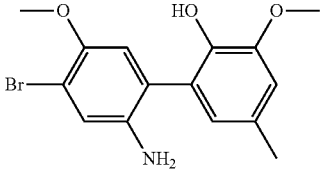 | 10% | >100:1 |
| 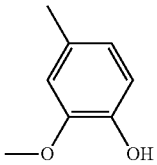 | 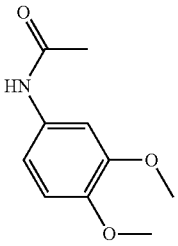 | 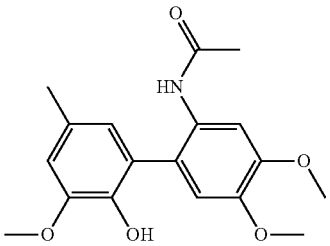 | 14% | 3:1 |
| 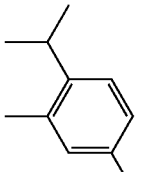 | 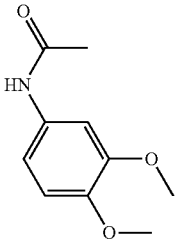 | 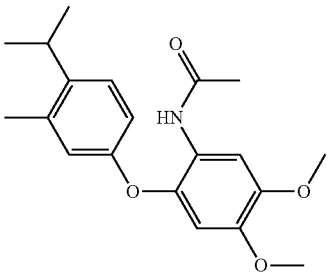 | 18% | >100:1 |

TABLE 1-continued

| Component 1 | Component 2 | Product | Yield (isolated)[a] | Selectivity (AB:BB)[b] |
|---|---|---|---|---|
| 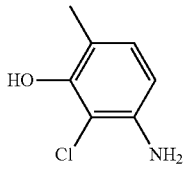 | 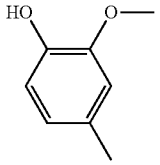 | 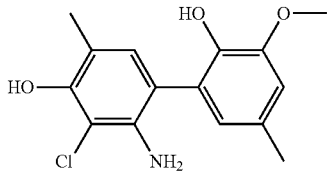 | 21% | 30:1 |

Electrolysis parameters: n(component 1) = 5 mmol, n(component 1) = 15 mmol, conductive salt: MTBS, c(MTBS) = 0.09M, V(solvent) = 33 ml, solvent: HFIP
Electrode material: glassy carbon, j = 2.8 mA/cm$^2$, T = 50° C., Q = 2 F*n(component 1).
The electrolysis is effected under galvanostatic conditions.
[a]isolated yield based on n(component 1);
[b]determined via GC.
AB: cross-coupling product, BB: homo-coupling product.

GENERAL PROCEDURES

Cyclic Voltammetry (CV)

A Metrohm 663 VA stand equipped with a ρAutolab type III potentiostat was used (Metrohm AG, Herisau, Switzerland). WE: glassy carbon electrode, diameter 2 mm; AE: glassy carbon rod; RE: Ag/AgCl in saturated LiCl/EtOH. Solvent: HFIP+0-25% v/v MeOH. Oxidation criterion: j=0.1 mA/cm$^2$, v=50 mV/s, T=20° C. Mixing during the measurement. c(aniline derivative)=151 mM, conductive salt: $Et_3NMe$ $O_3SOMe$ (MTES), c(MTES)=0.09M.

Chromatography

The preparative liquid chromatography separations via flash chromatography were conducted with a maximum pressure of 1.6 bar on 60 M silica gel (0.040-0.063 mm) from Macherey-Nagel GmbH & Co, Düren. The unpressurized separations were conducted on Geduran Si 60 silica gel (0.063-0.200 mm) from Merck KGaA, Darmstadt. The solvents used as eluents (ethyl acetate (technical grade), cyclohexane (technical grade)) had been purified beforehand by distillation on a rotary evaporator.

For thin-layer chromatography (TLC), ready-made PSC silica gel 60 F254 plates from Merck KGaA, Darmstadt were used. The Rf values are reported as a function of the eluent mixture used. Staining of the TLC plates was effected using a cerium-molybdatophosphoric acid solution as a dipping reagent. Cerium-molybdatophosphoric acid reagent: 5.6 g of molybdatophosphoric acid, 2.2 g of cerium(IV) sulphate tetrahydrate and 13.3 g of concentrated sulphuric acid to 200 milliliters of water.

Gas Chromatography (GC/GCMS)

The gas chromatography analyses (GC) of product mixtures and pure substances were effected with the aid of the GC-2010 gas chromatograph from Shimadzu, Japan. Measurement is effected on an HP-5 quartz capillary column from Agilent Technologies, USA (length: 30 m; internal diameter: 0.25 mm; film thickness of the covalently bound stationary phase: 0.25 μm; carrier gas: hydrogen; injector temperature: 250° C.; detector temperature: 310° C.; programme: "hard" method: start temperature 50° C. for 1 min, heating rate: 15° C./min, final temperature 290° C. for 8 min). Gas chromatography mass spectra (GCMS) of product mixtures and pure substances were recorded with the aid of the GC-2010 gas chromatograph combined with the GCMS-QP2010 mass detector from Shimadzu, Japan. Measurement is effected on an HP-1 quartz capillary column from Agilent Technologies, USA (length: 30 m; internal diameter: 0.25 mm; film thickness of the covalently bound stationary phase: 0.25 μm; carrier gas: hydrogen; injector temperature: 250° C.; detector temperature: 310° C.; programme: "hard" method: start temperature 50° C. for 1 min, heating rate: 15° C./min, final temperature 290° C. for 8 min; GCMS: ion source temperature: 200° C.).

Melting Points

Melting points were measured with the aid of the SG 2000 melting point measuring instrument from HW5, Mainz and are uncorrected.

Elemental Analysis

The elemental analyses were conducted in the Analytical Division of the Department of Organic Chemistry at the Johannes Gutenberg University of Mainz on a Vario EL Cube from Foss-Heraeus, Hanau.

Mass Spectrometry

All electrospray ionization analyses (ESI+) were conducted on a QT of Ultima 3 from Waters Micromasses, Milford, Mass. EI mass spectra and the high-resolution EI spectra were measured on an instrument of the MAT 95 XL sector-field instrument type from Thermo Finnigan, Bremen.

NMR Spectroscopy

The NMR spectroscopy studies were conducted on multinuclear resonance spectrometers of the AC 300 or AV II 400 type from Bruker, Analytische Messtechnik, Karlsruhe. The solvent used was $CDCl_3$. The $^1H$ and $^{13}C$ spectra were calibrated according to the residual content of undeuterated solvent according to the NMR Solvent Data Chart from Cambridge Isotopes Laboratories, USA. Some of the $^1H$ and $^{13}C$ signals were assigned with the aid of H,H COSY, H,H NOESY, H,C HSQC and H,C HMBC spectra. The chemical shifts are reported as δ values in ppm. For the multiplicities of the NMR signals, the following abbreviations were used: s (singlet), bs (broad singlet), d (doublet), t (triplet), q (quartet), m (multiplet), dd (doublet of doublets), dt (doublet of triplets), tq (triplet of quartets). All coupling constants J were reported with the number of bonds covered in Hertz (Hz). The numbers reported in the signal assignment correspond to the numbering given in the formula schemes, which need not correspond to IUPAC nomenclature.

GM1: General Method for Electrochemical Cross-Coupling 2-4 mmol of the respective deficiency component are dissolved together with 6-12 mmol of the respective second component to be coupled in the amounts of 1,1,1,3,3,3-hexafluoroisopropanol (HFIP) and MeOH specified and converted in an undivided beaker cell with glassy carbon electrodes. The electrolysis is effected under galvanostatic conditions.

The reaction is stirred and heated to 50° C. with the aid of a water bath. After the end of the electrolysis, the cell contents are transferred together with HFIP into a 50 ml round-bottom flask and the solvent is removed under reduced pressure on a rotary evaporator at 50° C., 200-70 mbar. Unconverted reactant is retained by means of short-path distillation or Kugelrohr distillation (100° C., $10^{-3}$ mbar).

Electrode Material

Anode: glassy carbon

Cathode: glassy carbon

Electrolysis Conditions:

Temperature [T]: 50° C.

Current [I]: 25 mA

Current density [j]: 2.8 mA/cm$^2$

Quantity of charge [Q]: 2 F (per deficiency component)

Terminal voltage [$U_{max}$]: 3-5 V

Schematic Cell Structure

FIG. 3 shows the structure of the cell in schematic form. This cell has the following components:

1": stainless steel holders for electrodes

2": Teflon stopper

3": beaker cell with attached outlet for reflux condenser connection

4": stainless steel clamp

5": glassy carbon electrodes

6": magnetic stirrer bar

N-Acetyl-2-amino-2'-hydroxy-4,5-dimethoxy-3'-(dimethylethyl)-5'-methylbiphenyl

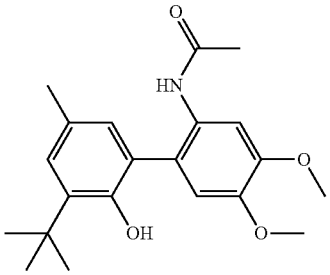

The electrolysis is conducted according to GM1 in an undivided beaker cell with glassy carbon electrodes. To this end, 0.62 g (3.79 mmol, 1.0 equiv.) of 2-(dimethylethyl)-4-methylphenol and 2.22 g (11.36 mmol, 3.0 equiv.) of N-(3,4-dimethoxyphenyl)acetamide are dissolved in 25 ml of HFIP, 0.77 g of MTBS is added and the electrolyte is transferred to the electrolysis cell. After the electrolysis, the solvent and unconverted amounts of reactant are removed under reduced pressure, the crude product is purified by flash chromatography on silica gel 60 in a 4:1 eluent (CH:EA) and the product is obtained as a colourless solid.

Yield: 447 mg (33%, 1.3 mmol)

GC (hard method, HP-5): $t_R$=16.14 min $R_f$(CH:EA=4:1)=0.17

$m_p$=182° C. (recrystallized from DCM)

$^1$H NMR (400 MHz, $CDCl_3$) δ=1.43 (s, 9H), 1.99 (s, 3H), 2.31 (s, 3H), 3.86 (s, 3H), 3.94 (s, 3H), 6.76 (s, 1H), 6.83 (d, J=1.9 Hz, 1H), 6.94 (s, 1H), 7.14 (d, J=1.9 Hz, 1H), 7.85 (s, 1H);

$^{13}$C NMR (101 MHz, $CDCl_3$) δ=20.95, 24.49, 29.68, 35.01, 56.22, 56.28, 77.16, 106.54, 113.45, 118.74, 124.10, 128.32, 128.97, 129.48, 129.66, 136.89, 146.42, 149.37, 149.40, 168.91.

HRMS for $C_{21}H_{27}NO_4$ (ESI+) [M+H$^+$]: calc.: 358.2018. found: 358.2017.

MS (EI, GCMS): m/z (%): 357 (100) [M]$^+$, 242 (100) [M−$CH_3$]$^+$, 315 (50) [M−$C_2H_2O$]$^+$.

2'-Amino-4'-bromo-2-hydroxy-3,5'-dimethoxy-5-methylbiphenyl

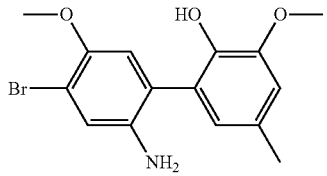

The electrolysis is conducted according to GM1 in an undivided beaker cell with glassy carbon electrodes. To this end, 0.43 g (2.15 mmol, 1.0 equiv.) of 4-bromo-3-methoxyaniline and 0.89 g (6.45 mmol, 3.0 equiv.) of 4-methylguaiacol are dissolved in 25 ml of HFIP, 0.77 g of MTBS is added and the electrolyte is transferred to the electrolysis cell. After the electrolysis, the solvent and unconverted amounts of reactant are removed under reduced pressure, the crude product is purified by flash chromatography on silica gel 60 in a 9:1 eluent (CH:EA) and the product is obtained as a brown oil.

Yield: 70 mg (10%, 0.2 mmol)

GC (hard method, HP-5): $t_R$=16.82 min $R_f$(CH:EA=4:1)=0.26

$^1$H NMR (400 MHz, DMSO-d6) δ=2.20 (s, 3H), 3.34 (bs, 3H), 3.75 (s, 3H), 3.77 (s, 3H), 6.48 (d, J=1.9 Hz, 1H), 6.59 (s, 1H), 6.75 (d, J=1.9 Hz, 1H), 7.06 (s, 1H);

$^{13}$C NMR (101 MHz, DMSO-d6) δ=20.68, 39.52, 55.81, 55.92, 98.31, 100.90, 111.86, 119.58, 120.97, 123.05, 124.50, 128.16, 134.14, 140.98, 143.99, 147.73, 154.88.

HRMS for $C_{15}H_{16}BrNO_3$ (ESI+) [M+Na$^+$]: calc.: 339.0392. found: 339.0390.

MS (EI, GCMS): m/z (%): 339 (100) [$^{81}$M]$^+$, 337 (100) [$^{79}$M]$^+$, 320 (12) [$^{81}$M−$CH_3$]$^+$, 318 (12) [$^{79}$M−$CH_3$]$^+$.

N-Acetyl-2-amino-2'-hydroxy-5'-methyl-2',4,5-trimethoxybiphenyl

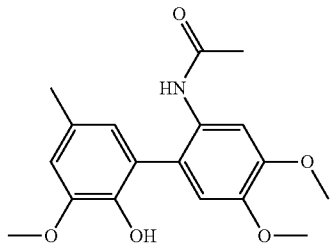

The electrolysis is conducted according to GM1 in an undivided beaker cell with glassy carbon electrodes. To this end, 0.52 g (3.79 mmol, 1.0 equiv.) of 4-methylguaiacol and 2.22 g (11.37 mmol, 3.0 equiv.) of N-(3,4-dimethoxyphenyl) acetamide are dissolved in 25 ml of HFIP, 0.77 g of MTBS is added and the electrolyte is transferred to the electrolysis cell. After the electrolysis, the solvent and unconverted amounts of reactant are removed under reduced pressure, the crude product is purified by flash chromatography on silica gel 60 in a 2:3 eluent (CH:EA)+1% AcOH and the product is obtained as a viscous, pale yellow oil.

Yield: 173 mg (14%, 0.52 mmol)

GC (hard method, HP-5): $t_R$=16.11 min $R_f$(CH:EA=4:1)=0.26

$^1$H NMR (400 MHz, $CDCl_3$) δ=2.13 (s, 3H), 2.33 (s, 3H), 3.71 (s, 3H), 3.86 (s, 3H), 3.88 (s, 3H), 6.46 (s, 1H), 6.64-6.70 (m, 1H), 6.76 (d, J=8.1 Hz, 1H), 6.79 (d, J=1.9 Hz, 1H), 7.83 (bs, 1H), 8.07 (s, 1H);

$^{13}$C NMR (101 MHz, $CDCl_3$) δ=21.35, 24.80, 56.01, 56.35, 77.16, 103.27, 105.06, 113.51, 119.03, 121.55, 123.10, 134.57, 139.32, 143.77, 145.07, 145.14, 150.05, 168.34.

HRMS for $C_{18}H_{21}NO_5$ (ESI+) [M+Na$^+$]: calc.: 332.1498. found: 332.1499.

MS (EI, GCMS): m/z (%): 331 (100) [M]$^+$, 289 (20) [M−$C_2H_2O$]$^+$, 318 (12) [M−$C_2H_5NO$]$^+$.

N-Acetyl-2-amino-3'-methyl-4'-(methylethyl)-4,5-dimethoxydiphenyl ether

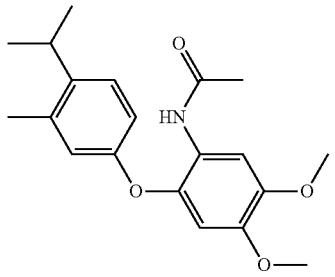

The electrolysis is conducted according to GM1 in an undivided beaker cell with glassy carbon electrodes. To this end, 0.75 g (5.00 mmol, 1.0 equiv.) of 3-methyl-4-(methylethyl)phenol and 2.93 g (15.00 mmol, 3.0 equiv.) of N-(3,4-dimethoxyphenyl)acetamide are dissolved in 33 ml of HFIP, 1.02 g of MTBS are added and the electrolyte is transferred to the electrolysis cell. After the electrolysis, the solvent and unconverted amounts of reactant are removed under reduced pressure, the crude product is purified by flash chromatography on silica gel 60 in a 3:2 eluent (CH:EA) and the product is obtained as a colourless solid.

Yield: 313 mg (18%, 0.91 mmol)

GC (hard method, HP-5): $t_R$=16.38 min $R_f$ (CH:EA=3:2)=0.26

$m_p$=112° C. (recrystallized from CH)

$^1$H NMR (400 MHz, $CDCl_3$) δ=1.20 (s, 3H), 1.22 (s, 3H), 2.10 (s, 3H), 2.29 (s, 3H), 3.09 (hept, J=6.9, 6.9, 6.8, 6.8, 6.8, 6.8 Hz, 1H), 3.74 (s, 3H), 3.90 (s, 3H), 6.52 (s, 1H), 6.65-6.79 (m, 2H), 7.16 (d, J=8.4 Hz, 1H), 7.53 (s, 1H), 8.10 (s, 1H);

$^{13}$C NMR (101 MHz, $CDCl_3$) δ=19.52, 23.43, 24.85, 28.84, 56.32, 56.35, 77.16, 104.23, 104.98, 114.49, 118.50, 123.77, 126.13, 137.07, 137.81, 141.81, 145.33, 145.44, 155.17, 168.31.

HRMS for $C_{20}H_{23}NO_4$ (ESI+) [M+Na$^+$]: calc.: 366.1681. found: 366.1676.

MS (EI, GCMS): m/z (%): 343 (100) [M]$^+$, 301 (20) [M−$C_2H_2O$]$^+$, 286 (80) [M−$C_2H_5NO$]$^+$.

2'-Amino-3'-chloro-2,4-dihydroxy-5,5'-dimethyl-3-methoxybiphenyl

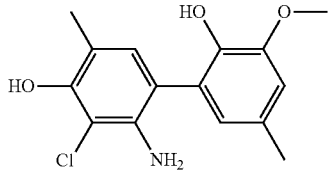

The electrolysis is conducted according to GM1 in an undivided beaker cell with glassy carbon electrodes. To this end, 0.60 g (3.79 mmol, 1.0 equiv.) of 2-chloro-3-hydroxy-4-methylaniline and 1.57 g (11.36 mmol, 3.0 equiv.) of 4-methylguaiacol are dissolved in 25 ml of HFIP, 0.77 g of MTBS is added and the electrolyte is transferred to the electrolysis cell. After the electrolysis, the solvent and unconverted amounts of reactant are removed under reduced pressure, the crude product is purified by flash chromatography on silica gel 60 in a 4:1 eluent (CH:EA) and the product is obtained as a dark brown solid.

Yield: 221 mg (20%, 0.76 mmol)

GC (hard method, HP-5): $t_R$=15.64 min $R_f$(CH:EA=4:1)=0.23

$^1$H NMR (400 MHz, DMSO-d6) δ=2.11 (s, 3H), 2.24 (s, 3H), 3.81 (s, 3H), 6.49 (s, 1H), 6.68 (s, 1H), 6.77 (s, 1H), 8.45 (bs, 1H), 8.77 (bs, 1H);

$^{13}$C NMR (101 MHz, DMSO-d6) δ=16.12, 20.74, 55.83, 107.30, 111.57, 113.52, 116.93, 123.46, 126.07, 128.05, 130.42, 140.28, 141.07, 147.65, 150.18.

HRMS for $C_{15}H_{16}ClNO_3$ (ESI+) [M+H$^+$]: calc.: 294.0897. found: 294.0901.

MS (EI, GCMS): m/z (%): 293 (100) [M]$^+$, 276 (100) [M−OH]$^+$.

BRIEF DESCRIPTION OF THE DRAWINGS

FIG. 1 shows a reaction apparatus in which the above-described coupling reaction can be conducted. The apparatus comprises a nickel cathode (1) and an anode of boron-doped diamond (BDD) on silicon or another support material, or another electrode material (5) known to those skilled in the art. The apparatus can be cooled with the aid of the cooling jacket (3). The arrows here indicate the flow direction of the cooling water. The reaction chamber is sealed with a Teflon stopper (2). The reaction mixture is mixed by a magnetic stirrer bar (7). On the anodic side, the apparatus is sealed by means of screw clamps (4) and seals (6).

FIG. 2 shows a reaction apparatus in which the above-described coupling reaction can be conducted on a larger scale. The apparatus comprises two glass flanges (5'), through which, by means of screw clamps (2') and seals, electrodes (3') of boron-doped diamond (BDD)-coated support materials or other electrode materials known to those skilled in the art are pressed on. The reaction chamber can be provided with a reflux condenser via a glass sleeve (1'). The reaction mixture is mixed with the aid of a magnetic stirrer bar (4').

FIGS. 4 to 10 each show the change in the oxidation potential (V) as a function of the proportion of methanol (MeOH) to which the solvent 1,1,1,3,3,3-hexafluoroisopropanol (HFIP) has been added. The numbers in the legends indicate the position of the substituent on the benzene ring in relation to the —$NH_2$ or the —NH—CO—$CH_3$ group: 2=ortho, 3=meta, 4=para. It is clearly apparent from the figures that the oxidation potential can be altered by the addition of methanol.

Figure 1:
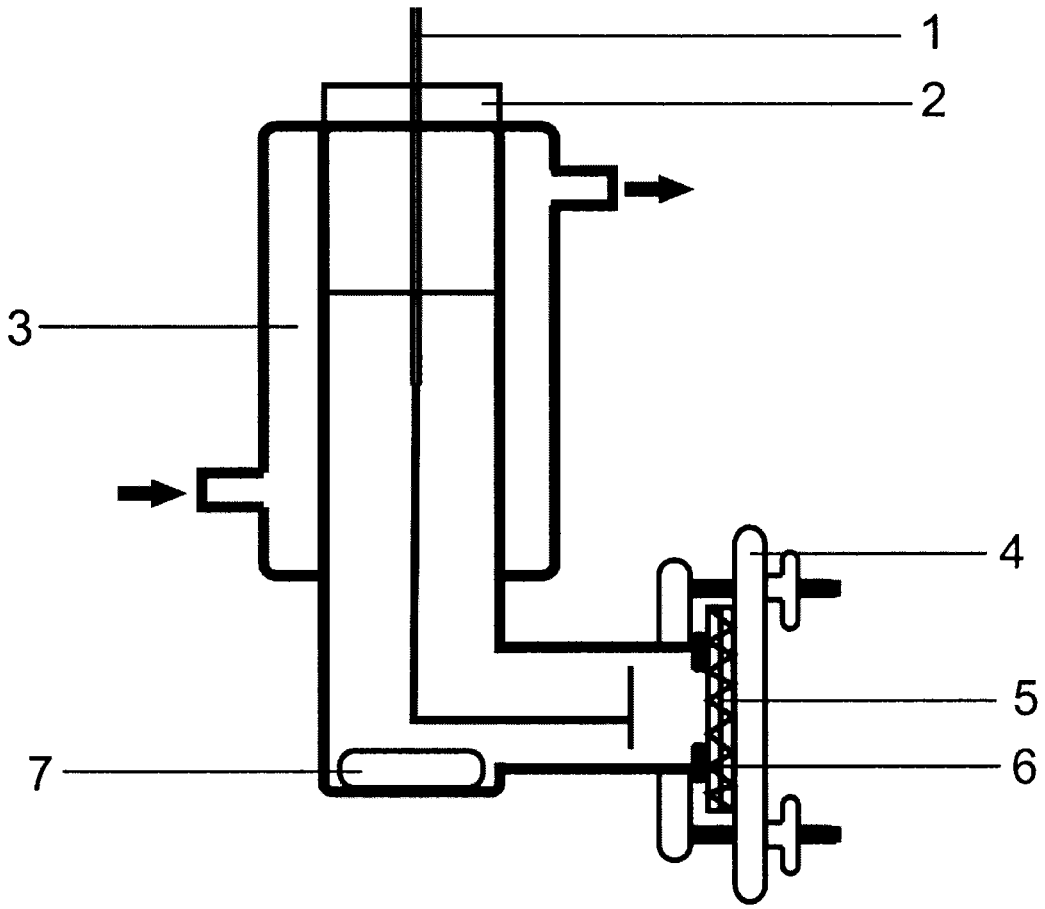
FIG. 1 shows a reaction apparatus for electrochemical C—C coupling phenol to aniline.
Figure 2:
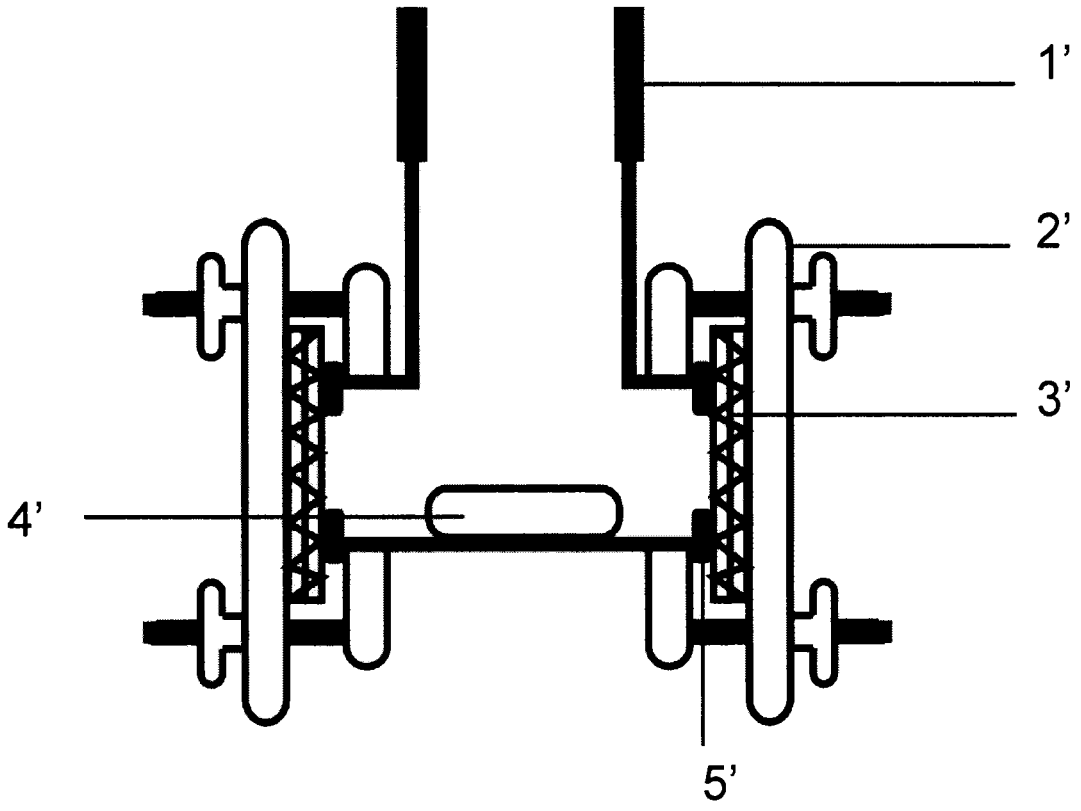
FIG. 2 shows a reaction apparatus for large scale electrochemical C—C coupling phenol to aniline.
Figure 3:
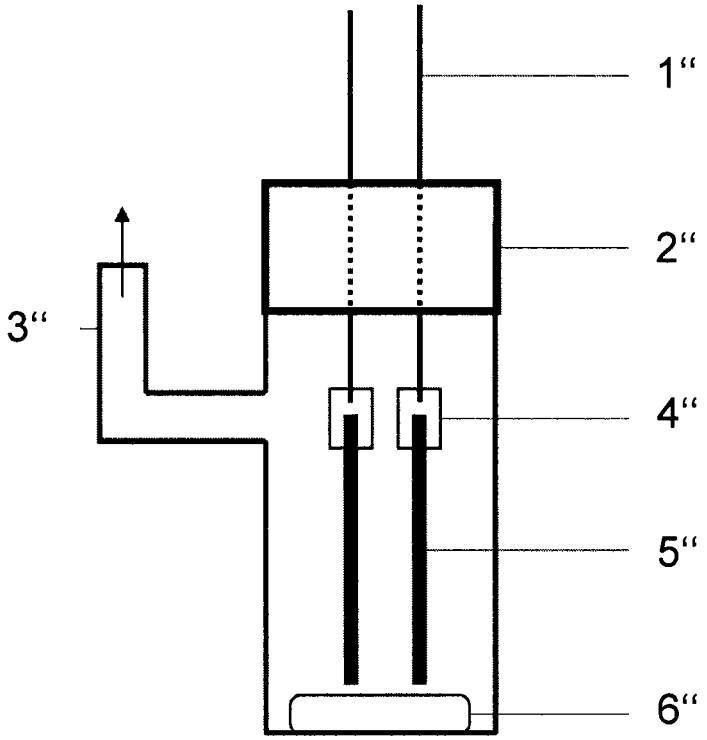
FIG. 3 shows the schematic structure of an electrochemical cell.
Figure 4:
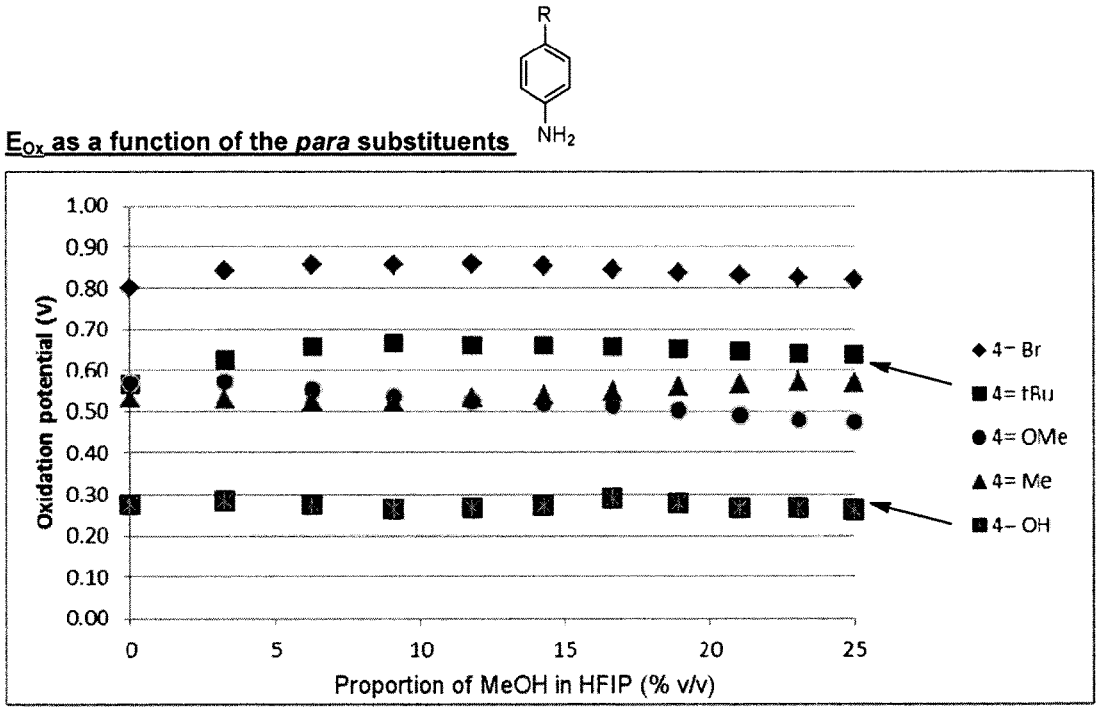
FIG. 4 shows $E_{Ox}$ as a function of various para substituents on aniline.
Figure 5:
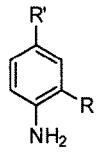
FIG. 5 shows $E_{Ox}$ as a function of various 2,4-disubstituents on aniline.
Figure 5:
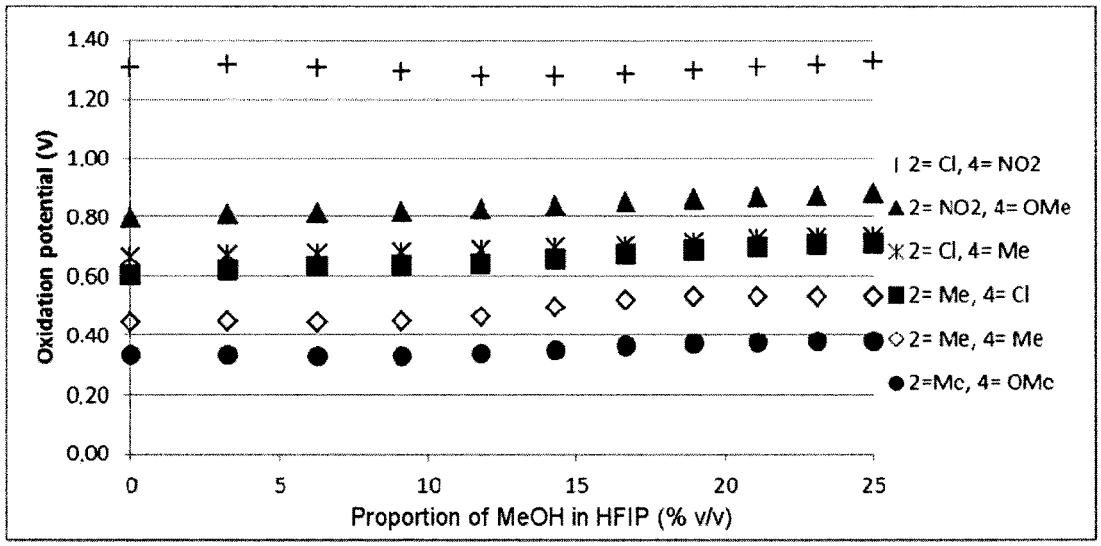
Figure 6:
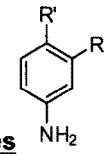
FIG. 6 shows $E_{Ox}$ as a function of various 3,4-disubstituents on aniline.
Figure 6:
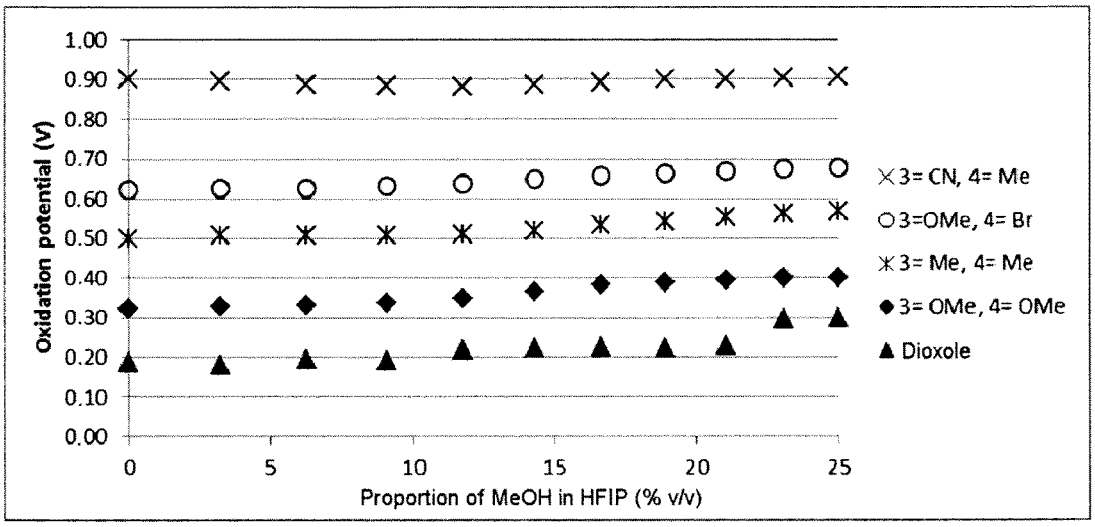
Figure 7:
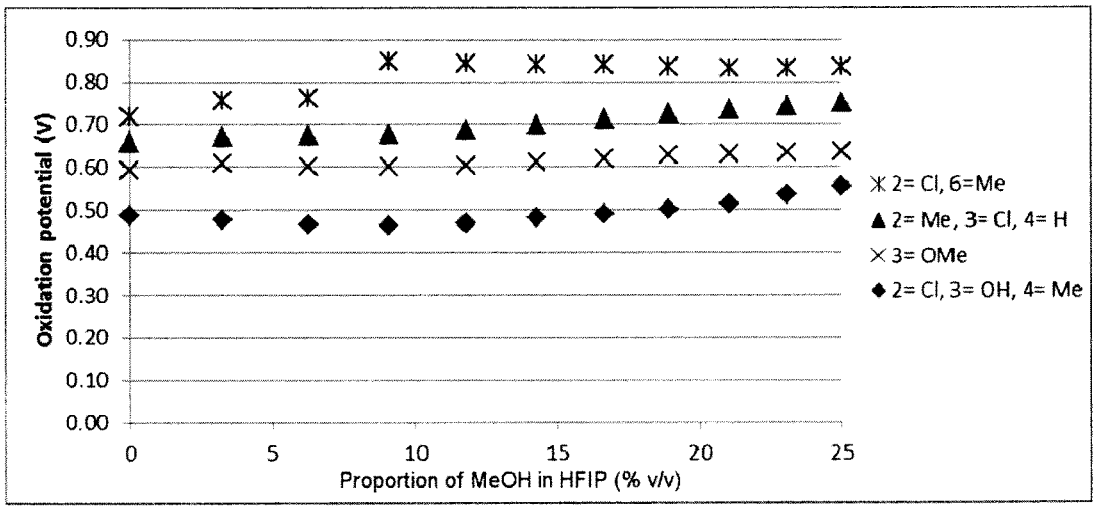
FIG. 7 shows $E_{Ox}$ as a function of various other substituents on aniline.
Figure 8:
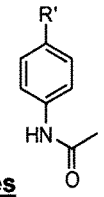
FIG. 8 shows $E_{Ox}$ as a function of various 4-substituents on N-acetylaniline.
Figure 8:
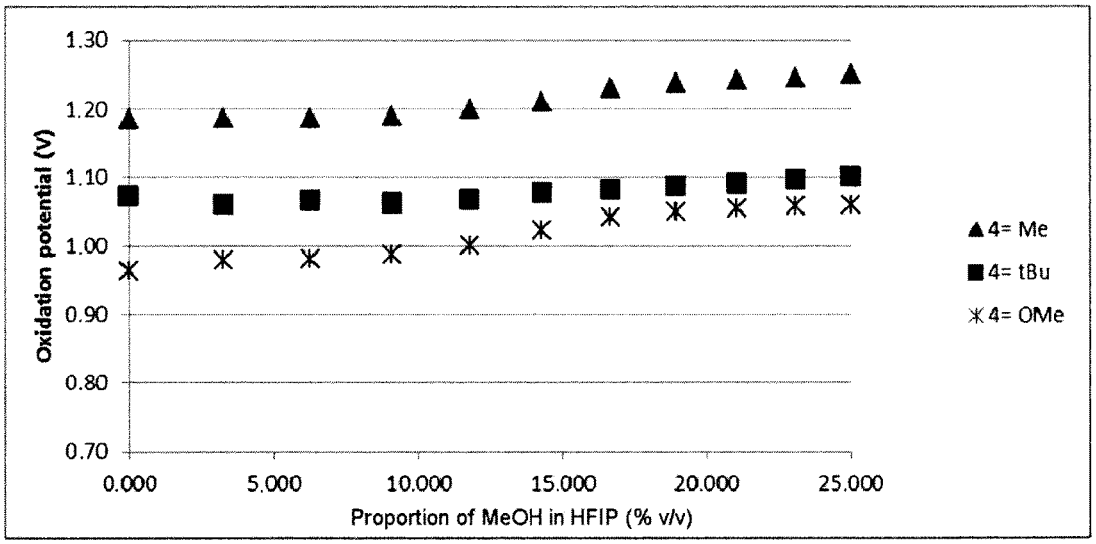
Figure 9:
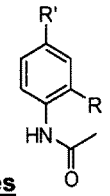
FIG. 9 shows $E_{Ox}$ as a function of various 2,4-disubstituents on N-acetylaniline.
Figure 9:
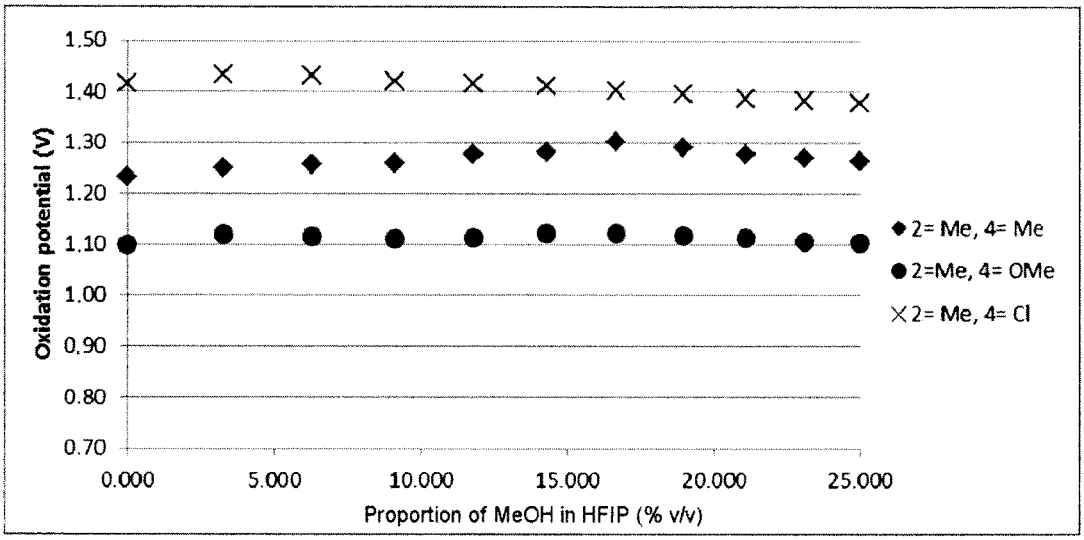
Figure 10:
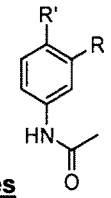
FIG. 10 shows $E_{Ox}$ as a function of various 3,4-disubstituents on N-acetylaniline.
Figure 10:
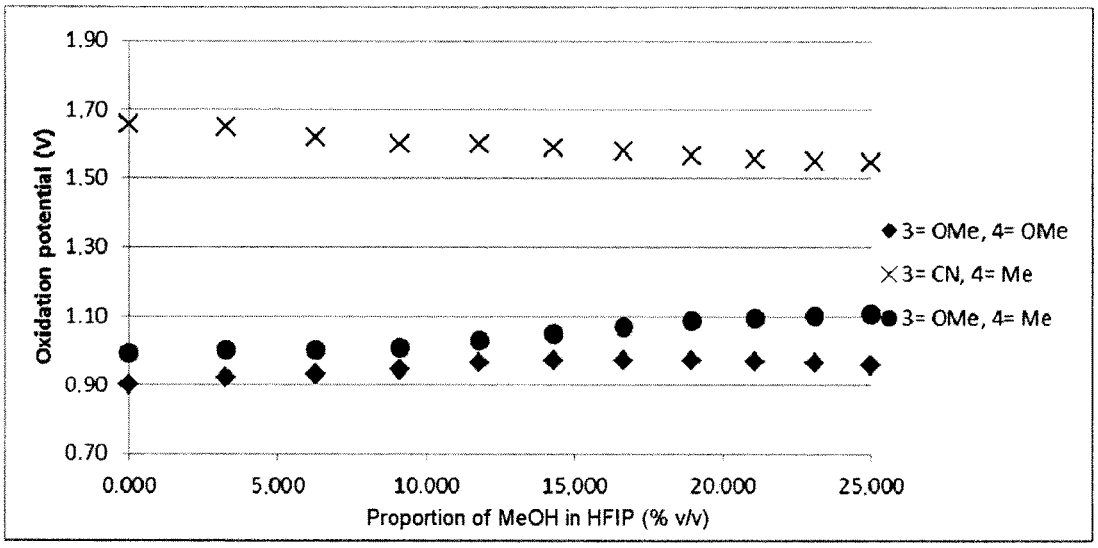

The invention claimed is:

1. Electrochemical process for C—C cross-coupling a phenol to an anilide, wherein selectivity of producing a C—C cross-coupled compound selected from the group consisting of formulae (I) to (V) to C—C homo-coupled product is at least 3:1, comprising:

a') introducing a solvent or solvent mixture and a conductive salt into a reaction vessel, b') adding a phenol having an oxidation potential $E_{Ox}1$ to the reaction vessel, and c') adding an anilide having an oxidation potential $E_{Ox}2$ to the reaction vessel, to form a reaction solution comprising the solvent or solvent mixture, the conductive salt, the phenol, and the anilide in the reaction vessel, where: $E_{Ox}2>E_{Ox}1$ and $E_{Ox}2-E_{Ox}1=\Delta E$, the anilide being added in excess relative to the phenol, and the solvent or solvent mixture being selected such that ΔE is within the range from 10 mV to 450 mV, d') introducing two electrodes into the reaction solution, e') applying a voltage to the electrodes, and f') coupling the phenol and the anilide to produce the compound selected from the group consisting of formulae (I) to (V):

(I)

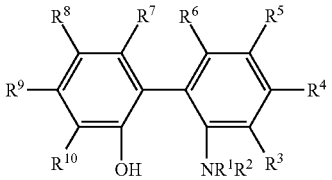

(II)

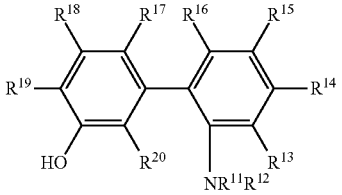

-continued (III)

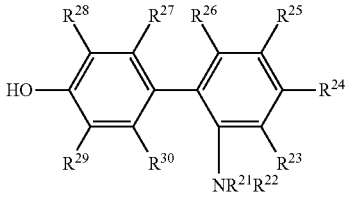

(IV)

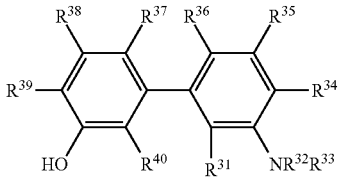

(V)

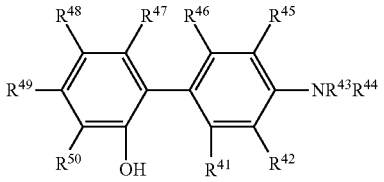

where the substituents $R^1$ to $R^{50}$ are each independently selected from the group of hydrogen, hydroxyl, ($C_1$-$C_{12}$)-alkyl, ($C_1$-$C_{12}$)-heteroalkyl, ($C_4$-$C_{14}$)-aryl, ($C_4$-$C_{14}$)-aryl-($C_1$-$C_{12}$)-alkyl, ($C_4$-$C_{14}$)-aryl-O—($C_1$-$C_{12}$)-alkyl, ($C_3$-$C_{14}$)-heteroaryl, ($C_3$-$C_{14}$)-heteroaryl-($C_1$-$C_{12}$)-alkyl, ($C_3$-$C_{12}$)-cycloalkyl, ($C_3$-$C_{12}$)-cycloalkyl-($C_1$-$C_{12}$)-alkyl, ($C_3$-$C_{12}$)-heterocycloalkyl, ($C_3$-$C_{12}$)-heterocycloalkyl-($C_1$-$C_{12}$)-alkyl, O—($C_1$-$C_{12}$)-alkyl, O—($C_1$-$C_{12}$)-heteroalkyl, O—($C_4$-$C_{14}$)-aryl, O—($C_4$-$C_{14}$)-aryl-($C_1$-$C_{14}$)-alkyl, O—($C_3$-$C_{14}$)-heteroaryl, O—($C_3$-$C_{14}$)-heteroaryl-($C_1$-$C_{14}$)-alkyl, O—($C_3$-$C_{12}$)-cycloalkyl, O—($C_3$-$C_{12}$)-cycloalkyl-($C_1$-$C_{12}$)-alkyl, O—($C_3$-$C_{12}$)-heterocycloalkyl, O—($C_3$-$C_{12}$)-heterocycloalkyl-($C_1$-$C_{12}$)-alkyl, halogens, S—($C_1$-$C_{12}$)-alkyl, S—($C_1$-$C_{12}$)-heteroalkyl, S—($C_4$-$C_{14}$)-aryl, S—($C_4$-$C_{14}$)-aryl-($C_1$-$C_{14}$)-alkyl, S—($C_3$-$C_{14}$)-heteroaryl, S—($C_3$-$C_{14}$)-heteroaryl-($C_1$-$C_{14}$)-alkyl, S—($C_3$-$C_{12}$)-cycloalkyl, S—($C_3$-$C_{12}$)-cycloalkyl-($C_1$-$C_{12}$)-alkyl, S—($C_3$-$C_{12}$)-heterocycloalkyl, ($C_1$-$C_{12}$)-acyl, ($C_4$-$C_{14}$)-aroyl, ($C_4$-$C_{14}$)-aroyl-($C_1$-$C_{14}$)-alkyl, ($C_3$-$C_{14}$)-heteroaroyl, ($C_1$-$C_{14}$)-dialkylphosphoryl, ($C_4$-$C_{14}$)-diarylphosphoryl, ($C_3$-$C_{12}$)-alkylsulphonyl, ($C_3$-$C_{12}$)-cycloalkylsulphonyl, ($C_4$-$C_{12}$)-arylsulphonyl, ($C_1$-$C_{12}$)-alkyl-($C_4$-$C_{12}$)-arylsulphonyl, ($C_3$-$C_{12}$)-heteroarylsulphonyl, (C═O)O—($C_1$-$C_{12}$)-alkyl, (C═O)O—($C_1$-$C_{12}$)-heteroalkyl, or (C═O)O—($C_4$-$C_{14}$)-aryl, where the alkyl, heteroalkyl, cycloalkyl, heterocycloalkyl, aryl and heteroaryl groups mentioned are optionally mono- or polysubstituted; and where $R^1$ or $R^2$ in formula (I), $R^{11}$ or $R^{12}$ in formula (II), $R^{21}$ or $R^{22}$ in formula (III), $R^{32}$ or $R^{33}$ in formula (IV); and $R^{43}$ or $R^{44}$ in formula (V) are selected from the group consisting of ($C_1$-$C_{12}$)-acyl, ($C_4$-$C_{14}$)-aroyl, ($C_4$-$C_{14}$)-aroyl-($C_1$-$C_{14}$)-alkyl, ($C_3$-$C_{14}$)-heteroaroyl, (C═O)O—($C_1$-$C_{12}$)-alkyl, (C═O)O—($C_1$-$C_{12}$)-heteroalkyl, and (C═O)O—($C_4$-$C_{14}$)-aryl.

2. The process according to claim 1, wherein the anilide is added in at least twice the amount relative to the phenol.

3. The process according to claim 1, wherein the ratio of phenol to anilide is in the range from 1:2 to 1:4.

4. The process according to claim 1, wherein the solvent or solvent mixture is selected such that ΔE is in the range from 20 mV to 400 mV.

5. The process according to claim 1, wherein the reaction solution is free of organic oxidizing agents.

6. The process according to claim 1, wherein the phenol is Ib when the anilide is Ia, the phenol is IIb when the anilide is IIa, the phenol is IIIb when the anilide is IIIa, the phenol is IVb when the anilide is IVa, and the phenol is Vb when the anilide is Va:

(Ia)

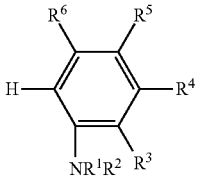

(Ib)

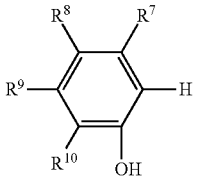

(IIa)

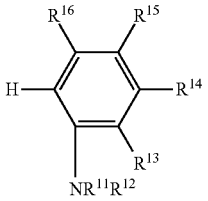

(IIb)

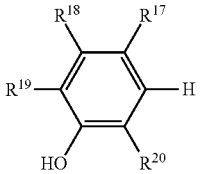

(IIIa)

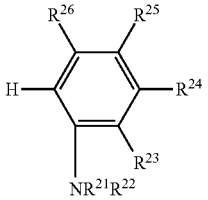

(IIIb)

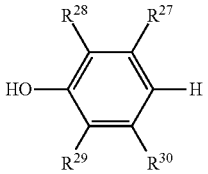

(IVa)

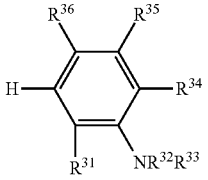

-continued (IVb)

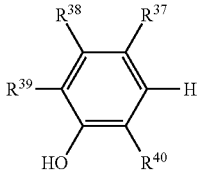

(Va)

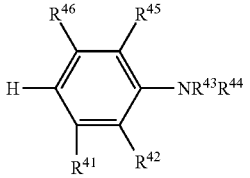

(Vb)

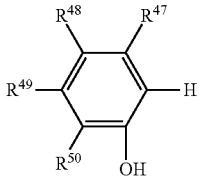

where the substituents $R^1$ to $R^{50}$ are each independently selected from the group consisting of hydrogen, hydroxyl, $(C_1-C_{12})$-alkyl, $(C_1-C_{12})$-heteroalkyl, $(C_4-C_{14})$-aryl, $(C_4-C_{14})$-aryl-$(C_1-C_{12})$-alkyl, $(C_4-C_{14})$-aryl-O—$(C_1-C_{12})$-alkyl, $(C_3-C_{14})$-heteroaryl, $(C_3-C_{14})$-heteroaryl-$(C_1-C_{12})$-alkyl, $(C_3-C_{12})$-cycloalkyl, $(C_3-C_{12})$-cycloalkyl-$(C_1-C_{12})$-alkyl, $(C_3-C_{12})$-heterocycloalkyl, $(C_3-C_{12})$-heterocycloalkyl-$(C_1-C_{12})$-alkyl, O—$(C_1-C_{12})$-alkyl, O—$(C_1-C_{12})$-heteroalkyl, O—$(C_4-C_{14})$-aryl, O—$(C_4-C_{14})$-aryl-$(C_1-C_{14})$-alkyl, O—$(C_3-C_{14})$-heteroaryl, O—$(C_3-C_{14})$-heteroaryl-$(C_1-C_{14})$-alkyl, O—$(C_3-C_{12})$-cycloalkyl, O—$(C_3-C_{12})$-cycloalkyl-$(C_1-C_{12})$-alkyl, O—$(C_3-C_{12})$-heterocycloalkyl, O—$(C_3-C_{12})$-heterocycloalkyl-$(C_1-C_{12})$-alkyl, halogens, S—$(C_1-C_{12})$-alkyl, S—$(C_1-C_{12})$-heteroalkyl, S—$(C_4-C_{14})$-aryl, S—$(C_4-C_{14})$-aryl-$(C_{1-}C_{14})$-alkyl, S—$(C_3-C_{14})$-heteroaryl, S—$(C_3-C_{14})$-heteroaryl-$(C_1-C_{14})$-alkyl, S—$(C_3-C_{12})$-cycloalkyl, S—$(C_3-C_{12})$-cycloalkyl-$(C_1-C_{12})$-alkyl, S—$(C_3-C_{12})$-heterocycloalkyl, $(C_1-C_{12})$-acyl, $(C_4-C_{14})$-aroyl, $(C_4-C_{14})$-aroyl-$(C_1-C_{14})$-alkyl, $(C_3-C_{14})$-heteroaroyl, $(C_1-C_{14})$-dialkylphosphoryl, $(C_4-C_{14})$-diarylphosphoryl, $(C_3-C_{12})$-alkylsulphonyl, $(C_3-C_{12})$-cycloalkylsulphonyl, $(C_4-C_{12})$-arylsulphonyl, $(C_1-C_{12})$-alkyl-$(C_4-C_{12})$-arylsulphonyl, $(C_3-C_{12})$-heteroarylsulphonyl, (C═O)O—$(C_1-C_{12})$-alkyl, (C═O)O—$(C_1-C_{12})$-heteroalkyl, and (C═O)O—$(C_4-C_{14})$-aryl, where the alkyl, heteroalkyl, cycloalkyl, heterocycloalkyl, aryl and heteroaryl groups mentioned are optionally mono- or polysubstituted; and where $R^1$ or $R^2$ in formula (I), $R^{11}$ or $R^{12}$ in formula (II), $R^{21}$ or $R^{22}$ in formula (III), $R^{32}$ or $R^{33}$ in formula (IV); and $R^{43}$ or $R^{44}$ in formula (V) are selected from the group consisting of $(C_1-C_{12})$-acyl, $(C_4-C_{14})$-aroyl, $(C_4-C_{14})$-aroyl-$(C_1-C_{14})$-alkyl, $(C_3-C_{14})$-heteroaroyl, (C═O)O—$(C_1-C_{12})$-alkyl, (C═O)O—$(C_1-C_{12})$-heteroalkyl, and (C═O)O—$(C_4-C_{14})$-aryl.

7. The process according to claim 6, wherein the phenol is Ib and the anilide is Ia.

8. The process according to claim 6, wherein the phenol is IIb and the anilide is IIa.

9. The process according to claim 6, wherein the phenol is IIIb and the anilide is IIIa.

10. The process according to claim 6, wherein the phenol is IVb and the anilide is IVa.

11. The process according to claim 6, wherein the phenol is Vb and the anilide is Va.

12. The electrochemical process for C—C cross-coupling the phenol to the anilide according to claim 1, wherein the anilide is an acetanilide and the selectivity of producing the C—C cross-coupled compound selected from the group consisting of formulae (I) to (V) to C—C homo-coupled product is greater than 100:1.

13. An electrochemical process for C—C cross-coupling phenol or C-substituted phenol to an anilide, wherein selectivity of producing a C—C cross-coupled biaryl compound having both hydroxyl and amino functions to C—C homo-coupled product is at least 3:1, comprising:

a') introducing a solvent or solvent mixture and a conductive salt into a reaction vessel, b') adding the phenol or C-substituted phenol having an oxidation potential $E_{Ox}1$ to the reaction vessel, c') adding the anilide having an oxidation potential $E_{Ox}2$ to the reaction vessel, to form a reaction solution comprising the solvent or solvent mixture, the conductive salt, the phenol or C-substituted phenol, and the anilide in the reaction vessel, where:

$$E_{Ox}2>E_{Ox}1 \text{ and } E_{Ox}2-E_{Ox}1=\Delta E,$$

the anilide being added in excess relative to the phenol or C-substituted phenol, and the solvent or solvent mixture being selected such that ΔE is within the range from 10 mV to 450 mV, d') introducing two electrodes into the reaction solution, e') applying a voltage to the electrodes, and f') coupling the phenol or C-substituted phenol and the anilide to produce the biaryl compound having both hydroxyl and amino functions.

14. The electrochemical process for C—C cross-coupling the phenol to the anilide according to claim 1, wherein the selectivity of producing the C—C cross-coupled compound selected from the group consisting of formulae (I) to (V) to C—C homo-coupled product is greater than 100:1.

15. The electrochemical process for C—C cross-coupling the phenol or C-substituted phenol to the anilide according to claim 13, wherein the selectivity of producing the C—C cross-coupled biaryl compound having both hydroxyl and amino functions to C—C homo-coupled product is greater than 100:1.

16. The electrochemical process for C—C cross-coupling the phenol or C-substituted phenol to the anilide according to claim 13, wherein the anilide is an acetanilide and the selectivity of producing the C—C cross-coupled biaryl compound having both hydroxyl and amino functions to C—C homo-coupled product is greater than 100:1.

* * * * *